US011578936B2

(12) United States Patent
Schilling et al.

(10) Patent No.: US 11,578,936 B2
(45) **Date of Patent: *Feb. 14, 2023**

(54) ADJUSTABLE GAS BLOCK

(71) Applicant: LWRC International LLC, Cambridge, MD (US)

(72) Inventors: Robert Stanley Schilling, Easton, MD (US); Jason Lee Miller, Hurlock, MD (US); Michael R. Llewellyn, Salisbury, MD (US)

(73) Assignee: LWRC International LLC, Cambridge, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/506,651

(22) Filed: Oct. 20, 2021

(65) Prior Publication Data

US 2022/0113101 A1 Apr. 14, 2022

Related U.S. Application Data

(63) Continuation of application No. 16/430,413, filed on Jun. 3, 2019, now Pat. No. 11,175,105, which is a (Continued)

(51) Int. Cl.
*F41A 5/00* (2006.01)
*F41A 5/26* (2006.01)
*F41A 5/28* (2006.01)

(52) U.S. Cl.
CPC ..... *F41A 5/28* (2013.01)

(58) Field of Classification Search
CPC ..... F41A 5/28; F41A 5/26; F41A 5/18; F41A 19/03; F42B 12/44
(Continued)

(56) References Cited

U.S. PATENT DOCUMENTS 1,431,059 A 10/1922 Sutter
1,738,501 A 12/1929 Moore
(Continued)

OTHER PUBLICATIONS

US 8,752,473 B2, 06/2014, Gomez (withdrawn)
(Continued)

*Primary Examiner* — Michael D David

(74) *Attorney, Agent, or Firm* — Arnall Golden Gregory LLP

(57) ABSTRACT

Systems and methods for an adjustable gas block are described. Systems may include an adjustment subassembly. The adjustment subassembly may include a valve stem end with a front-most portion larger in diameter than the rear-most portion and a boss extending from the forward portion of the valve stem end; a valve ring surrounding the boss of the valve stem end; a valve threaded portion for receiving the boss of the valve stem end and having a threaded portion; and a valve rotator coupled to the valve threaded portion for adjusting the flow of gas. Systems may include a gas block assembly. The gas block assembly may include a gas block through hole; a first duct to direct pressurized gas from a barrel to a plenum; a second duct to direct a regulated volume of gas to a gas operating system; a seat valve to control the regulated volume of gas to the gas operating system; and a gas block threaded portion for coupling to the valve threaded portion. The adjustment subassembly may be coupled to the gas block assembly.

20 Claims, 8 Drawing Sheets

Related U.S. Application Data continuation of application No. 15/890,002, filed on Feb. 6, 2018, now Pat. No. 10,309,737, which is a continuation of application No. 15/000,587, filed on Jan. 19, 2016, now Pat. No. 9,995,546.

(60) Provisional application No. 62/105,001, filed on Jan. 19, 2015.

(58) Field of Classification Search
USPC ..... 89/193, 191.01, 1.51, 192
See application file for complete search history.

(56) References Cited

U.S. PATENT DOCUMENTS

| | | | | |
|---|---|---|---|---|
| 2,058,897 | A | 10/1936 | Marek | |
| 2,286,776 | A | 6/1942 | Burch et al. | |
| 2,340,293 | A | 2/1944 | Balleisen | |
| 2,560,292 | A | 7/1951 | Kauch | |
| 2,732,769 | A | 1/1956 | Simpson | |
| 2,748,662 | A | 6/1956 | Simpson | |
| 4,447,195 | A | 5/1984 | Schuck | |
| 4,714,091 | A | 12/1987 | Wagner | |
| 4,798,124 | A | 1/1989 | Hurlemann et al. | |
| 5,622,142 | A | 4/1997 | Strieber et al. | |
| 5,945,626 | A | 8/1999 | Robbins | |
| 7,275,529 | B2 | 10/2007 | Boys | |
| 7,451,679 | B2 | 11/2008 | Stevenson et al. | |
| 7,461,581 | B2 | 12/2008 | Gomez | |
| 7,775,150 | B2 | 8/2010 | Hochstrate et al. | |
| 7,856,917 | B2 | 12/2010 | Noveske | |
| 7,891,284 | B1 | 2/2011 | Barrett | |
| 8,316,750 | B2 | 11/2012 | Toeckes et al. | |
| 8,607,688 | B2 | 12/2013 | Cassels | |
| 8,863,639 | B2 | 10/2014 | Gomez | |
| 8,869,674 | B2 | 10/2014 | Ruck et al. | |
| 8,875,614 | B2 | 11/2014 | Gomez | |
| 9,091,498 | B1 | 7/2015 | Gomez | |
| 9,170,061 | B2 | 10/2015 | Gomez | |
| 9,243,859 | B1 | 1/2016 | Miller et al. | |
| 9,423,197 | B2 | 8/2016 | Gomez | |
| 9,506,704 | B2 | 11/2016 | Gomez | |
| 9,995,546 | B2 | 6/2018 | Schilling et al. | |
| 10,030,922 | B2 | 7/2018 | Gomez | |
| 10,309,737 | B2 | 6/2019 | Schilling et al. | |
| 10,480,876 | B2 | 11/2019 | Gomez | |
| 11,029,107 | B2 | 6/2021 | Gomez | |
| 11,175,105 | B2 | 11/2021 | Schilling et al. | |
| 2006/0086099 | A1 | 4/2006 | Dickerson et al. | |
| 2006/0283318 | A1 | 12/2006 | Beaty | |
| 2010/0101401 | A1 | 4/2010 | Toeckes et al. | |
| 2010/0218671 | A1 | 9/2010 | Mayberry et al. | |
| 2011/0186305 | A1 | 8/2011 | Wilde | |
| 2014/0260947 | A1* | 9/2014 | Gomez | F41G 1/02 89/193 |
| 2014/0283672 | A1 | 9/2014 | Sparling | |
| 2016/0265860 | A1 | 9/2016 | Schilling et al. | |
| 2019/0017760 | A1* | 1/2019 | Schilling | F41A 5/28 |

OTHER PUBLICATIONS

U.S. Appl. No. 12/220,725, filed Jul. 28, 2008, Gomez.
U.S. Appl. No. 15/335,951, filed Oct. 27, 2016, Gomez.
U.S. Appl. No. 62/105,001, filed Jan. 19, 2015, Schilling et al.
In the U.S. Patent and Trademark Office, Final Office Action in re: U.S. Appl. No. 12/929,928, dated Jul. 24, 2012, 7 pages.
In the U.S. Patent and Trademark Office, Final Office Action in re: U.S. Appl. No. 12/929,928, dated Sep. 12, 2013, 7 pages.
In the U.S. Patent and Trademark Office, Final Office Action in re: U.S. Appl. No. 14/291,455, dated Mar. 23, 2015, 7 pages.
In the U.S. Patent and Trademark Office, Final Office Action in re: U.S. Appl. No. 14/920,668, dated Feb. 10, 2016, 6 pages.
In the U.S. Patent and Trademark Office, Final Office Action in re: U.S. Appl. No. 15/243,707, dated Nov. 27, 2017.
In the U.S. Patent and Trademark Office, Notice of Allowance in re: U.S. Appl. No. 12/929,928, dated Feb. 3, 2014, 5 pages.
In the U.S. Patent and Trademark Office, Notice of Allowance in re: U.S. Appl. No. 13/593,021, dated Jun. 12, 2014, 5 pages.
In the U.S. Patent and Trademark Office, Notice of Allowance in re: U.S. Appl. No. 14/291,455, dated Jun. 26, 2015, 7 pages.
In the U.S. Patent and Trademark Office, Notice of Allowance in re: U.S. Appl. No. 14/484,715, dated Apr. 14, 2015, 6 pages.
In the U.S. Patent and Trademark Office, Notice of Allowance in re: U.S. Appl. No. 14/790,660, dated Jul. 27, 2016, 8 pages.
In the U.S. Patent and Trademark Office, Notice of Allowance in re: U.S. Appl. No. 14/920,668, dated Apr. 27, 2016, 5 pages.
In the U.S. Patent and Trademark Office, Notice of Allowance in re: U.S. Appl. No. 15/000,587, dated Apr. 7, 2017.
In the U.S. Patent and Trademark Office, Notice of Allowance in re: U.S. Appl. No. 15/000,587, dated Jan. 4, 2018.
In the U.S. Patent and Trademark Office, Notice of Allowance in re: U.S. Appl. No. 15/890,002, dated Jan. 14, 2019.
In the U.S. Patent and Trademark Office, Office Action in re: U.S. Appl. No. 12/220,725, dated Aug. 24, 2010, 7 pages.
In the U.S. Patent and Trademark Office, Office Action in re: U.S. Appl. No. 12/929,928, dated Jan. 12, 2012, 7 pages.
In the U.S. Patent and Trademark Office, Office Action in re: U.S. Appl. No. 12/929,928, dated Jan. 15, 2013, 8 pages.
In the U.S. Patent and Trademark Office, Office Action in re: U.S. Appl. No. 13/593,021, dated Feb. 5, 2014, 6 pages.
In the U.S. Patent and Trademark Office, Office Action in re: U.S. Appl. No. 14/291,455, dated Jul. 30, 2014, 9 pages.
In the U.S. Patent and Trademark Office, Office Action in re: U.S. Appl. No. 14/484,715, dated Dec. 19, 2014, 4 pages.
In the U.S. Patent and Trademark Office, Office Action in re: U.S. Appl. No. 14/790,660, dated Feb. 2, 2016, 8 pages.
In the U.S. Patent and Trademark Office, Office Action in re: U.S. Appl. No. 15/243,707, dated May 25, 2017.
In the U.S. Patent and Trademark Office, Office Action in re: U.S. Appl. No. 16/043,121, dated Apr. 26, 2019.

* cited by examiner

ADJUSTABLE GAS BLOCK

CLAIM OF PRIORITY

This application is a continuation of U.S. application Ser. No. 16/430,413 filed on Jun. 3, 2019, which is a continuation of U.S. application Ser. No. 15/890,002, filed Feb. 6, 2018, granted as U.S. Pat. No. 10,309,737, which is a continuation of U.S. application Ser. No. 15/000,587, filed Jan. 19, 2016, granted as U.S. Pat. No. 9,995,546, which claims priority to U.S. Provisional Application No. 62/105,001, filed Jan. 19, 2015, the contents of which are incorporated by reference in their entirety.

FIELD OF THE INVENTION

The present invention relates to systems and methods for self-loading firearms, and more specifically, to systems and methods for gas blocks for self-loading firearms to facilitate user adjustment of gas flow from a barrel into an operating system.

BACKGROUND OF THE INVENTION

The need to regulate the gas flow between the barrel and operating system of a firearm has been a concern since the introduction of auto-loading firearms. Gas is generated during the combustion of gun powder present in the cartridges used in modern firearms. This gas expands violently to push the bullet out of the firearm's barrel. These expanding gases are utilized as a means to operate the action of the host firearm. In modern firearms the preferred method of facilitating the function of an auto-loading weapon is as follows. A hole is placed through the barrel, generally on the top. Location of this hole or gas port varies between operating systems. Generally a gas port size is chosen to allow a broad range of ammunition to be utilized while guaranteeing the reliable function of the host firearm. Unfortunately due to varying lengths of barrels, ammunition variance, and other factors it is very difficult to choose a gas port size which universally works under all conditions. A popular way of dealing with these problems is to incorporate an adjustable gas block into the operating system.

An adjustable gas block allows for the flow of gas between the gas port in the barrel and the operating system of the firearm to be increased or decreased based on mitigating factors present at the time of use. These systems typically work by utilizing an oversized gas port with means to adjust the flow of gas into the operating system and by venting the unneeded gases from the barrel into the atmosphere thus generating flash and sound. Further, adjustment of the gas system typically requires a special tool and offers no way for the user to index the system and make adjustments due to mitigating circumstances quickly. Designs such as these are well known in the prior art and can be found on the Belgium FAL, Soviet SVD and the Yugoslavian M76 rifle.

Recent firearm designs such as the FN SCAR rifles have incorporated adjustable gas blocks to be used in conjunction with noise suppressors. Noise suppressors provide a means to redirect, cool and slow the expanding gases generated from the discharge of a firearm so that the resulting flash and sound generated by the firearm is minimized or eliminated. As a result, back pressure is generated forcing more gas into the firearm's operating system. This extra gas, or back pressure increases the firing rate of a weapon during its full auto function, fouls the weapon leading to premature malfunction and to a variety of feeding and extraction problems.

Problems with existing systems may occur due to variations in cartridge, such as different weights, different powder charges, different bullet jackets, etc., friction in the operating system that may change during the life of the rifle, buffer sprint set changes, and suppressors of different back-pressures. Existing systems may not allow for the rifle operator to compensate for these potential problems.

Needs exist for improved systems and methods for gas blocks for self-loading firearms to facilitate user adjustment of gas flow from a barrel into an operating system.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE PREFERRED EMBODIMENTS

Figure 1:
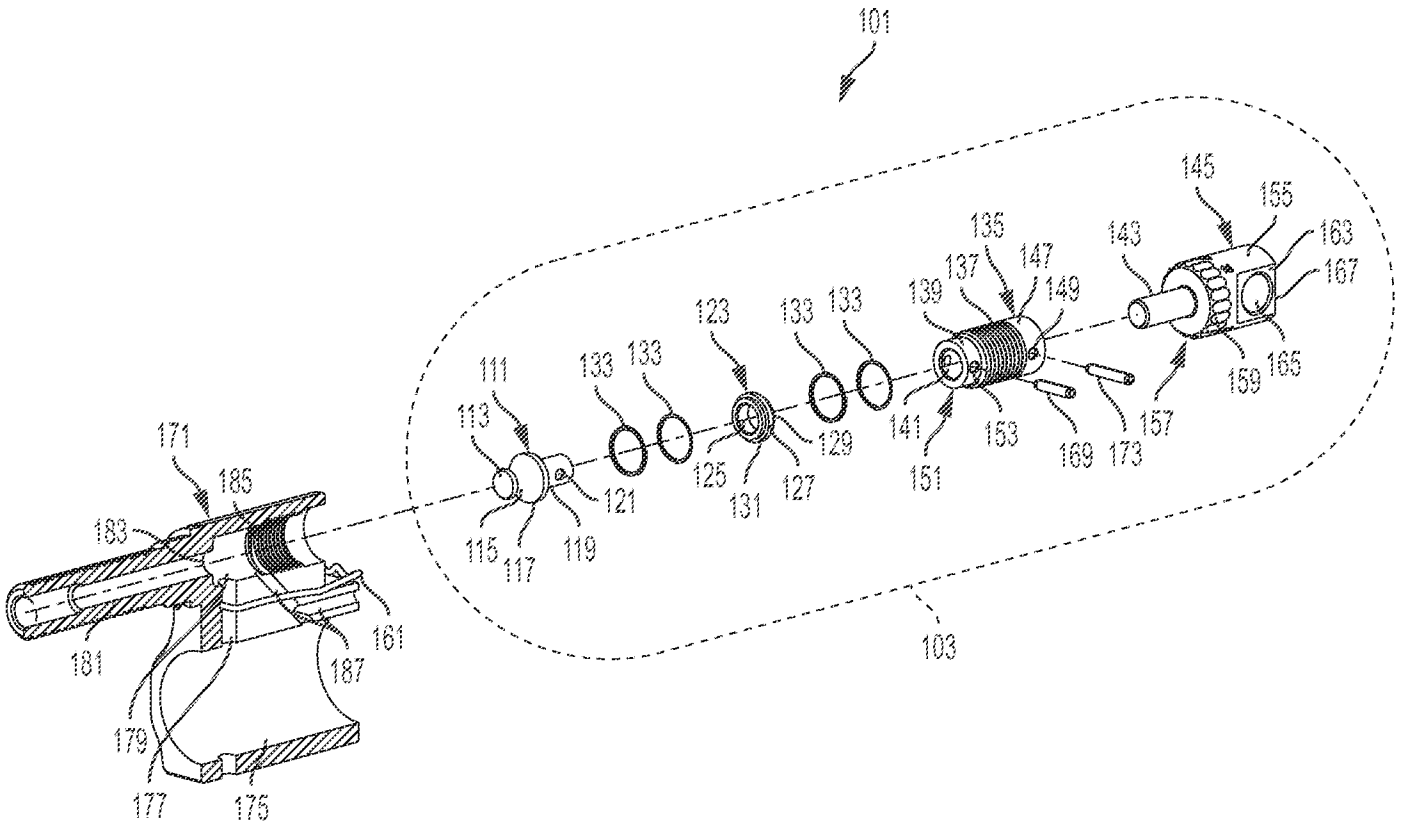
FIG. 1 shows an exploded view of an adjustable gas block assembly, according to one embodiment.

Systems and methods are described for gas blocks for self-loading firearms to facilitate user adjustment of gas flow from a barrel into an operating system. In particular, the systems and methods may be used for any purpose where adjustable gas blocks may be needed.

The systems and methods described herein may describe an adjustable gas block for gas piston operated rifles, both semi-automatic and automatic, with or without suppressors. A shooter may be able to adjust for varying ammunition parameters, suppressors of differing back pressures, changes in rifle conditions, such as an increase or decrease of bolt carrier/buffer system frictions, buffer spring set, and spent cartridge ejection angle.

In certain embodiments, the rifle operator may adjust the gas block via a multi-stepped opening or closing of a valve built into the gas block via an actuator. The number of steps per revolution of the actuator may vary from two or more steps to a continuous adjustment without discrete steps. In certain embodiments, there may be approximately 4 steps or more, approximately 5 steps or more, approximately 10 steps or more, approximately 15 steps or more, approximately 20 steps or more, approximately 30 steps or more, etc. Embodiments may allow for adjustment of the gas block after the rifle has been manufactured.

FIG. 1 shows an adjustable gas block assembly 101 according to one embodiment. An adjustment subassembly 103 may include various components. For reference in FIG. 1, the words "front", "forward", "frontward", etc. reference positions on the barrel end of a rifle, and may be considered to refer to the right side of the figure. The words "rear", "back", "rearward", etc. reference positions on the stock end of a rifle, and may be considered to refer to the left side of the figure.

A valve stem end 111 may have various configurations and dimensions depending on a particular use. The valve stem end 111 may be a generally round shape with a central axis. As shown in FIG. 1, the valve stem end 111 may have a rear-most portion 113 to regulate volume of high pressure gas that actuates the rifle's operating system. A middle portion 115 may be of a lesser diameter than the rear-most portion 113. In certain embodiments, the front-most portion 117 may be of a larger diameter than the rear-most portion 113 and may be used as a retaining flange. A generally cylindrical boss 119 may have a lesser diameter than the front-most portion 117. The boss 119 may extend frontward from the front-most position 117. The boss 119 may be concentric to the axis of the valve stem end 111. The boss 119 may have a through hole 121 to facilitate assembly. In certain embodiments, the through hole 121 may be perpendicular to and intersecting to the axis of the valve stem end 111.

A valve ring 123 may be a generally round component. In certain embodiments, the valve ring 123 may be cylindrical with an axial through hole 125. The diameter of the axial through hole 125 may be a close fit with the boss 119. The valve ring 123 may also have a flange 127 of increased diameter. The flange 127 may have at least one front shoulder 129 and at least one rear shoulder 131. The flange 127 and shoulders 129, 131 may be a close fit with inside diameters of one or more gas rings 133. In certain embodiments, there may be two gas rings 133 forward and two gas rings 133 rearward of the valve ring 123.

A valve threaded portion 135 may be a generally round part and may be generally cylindrical. The valve threaded portion 135 may include a concentrically threaded portion 137 located centrally with a rearward reduced diameter shoulder 139. An axial through hole 141 may pass through the valve threaded portion 135. The axial through hole 141 may be a close fit with boss 119 and boss 143 of a valve rotator 145. Forward unthreaded sections 147 of the valve threaded portion 135 may have a through hole 149. In certain embodiments, the through hole 149 may be perpendicular and intersecting to the axis of the valve threaded portion 135. Rearward unthreaded sections 151, such as the shoulder 139, of the valve threaded portion 135 may have a through hole 153. In certain embodiments, the through hole 153 may be perpendicular and intersecting to the axis of the valve threaded portion 135.

The valve rotator 145 may be a generally round part and may be generally cylindrical. The concentric boss 143 may be at a rear portion of the valve rotator 145. The concentric boss 143 may be of a lesser diameter than a forward section 155 of the valve rotator 145. In certain embodiments, a ring 157 of evenly spaced grooves 159 may be disposed around the circumference of a rear portion of the forward section 155. Other locations for the ring 157 may be provided. The number and placement of grooves 159 may vary. The grooves may facilitate control of an adjustment position by spring detent 161. The forward section 155 may contain one or more flat areas 163. The one or more flat areas 163 may be generally parallel to the axis of the valve rotator 145. In the embodiment shown in FIG. 1, the valve rotator 145 has two flat areas on opposite sides of the valve rotator 145. A through hole 165 may pass through the valve rotator between the flat areas 163. The through hole 165 may be perpendicular to the flat areas 163 and may intersect the axis of the valve rotator 145. The flat surfaces 163 and the through hole 165 may facilitate adjustment. Further adjustment facilitators may include knurls applied to an outer surface of the valve rotator 145, such as the frontward section 155, features on a front face 167 of the valve rotator 145 for coin or screw driver actuation, etc.

The adjustment subassembly 103 may be assembled as shown in FIG. 1 by inserting a first sub-assembly pin 169 through through hole 153 and through hole 121. Then transfer drill through through hole 149 after ascertaining a radial position of valve rotator 145 when the adjustment subassembly 103 is threaded completely into gas block assembly 171. A second sub-assembly pin 173 may be inserted into place in through hole 149.

The gas block assembly 171 may be a standard gas block used on a gas operated rifle, direct impingement operated or gas piston operated, semi-automatic or full-automatic. The gas block assembly 171 may have a through hole 175. The through hole 175 may be used to secure the gas block onto a gas block journal on the rifle's barrel. A first duct 177 may direct pressurized gas from the barrel's bore into a plenum-like space 179, also referred to herein as a plenum. A second duct 181 may be generally parallel to the axis of the through hole 175 may channel the regulated volume of gas to the rifle's gas operating system. A rearmost portion of the plenum-like space or plenum 179 may be a seat valve 183. The seat valve 183 may be used by the adjustment subassembly 103 to regulate the volume of gas channeled to the rifle's gas operating system by adjusting the gap between the seat valve 183 and the rear-most portion 113 of the adjustment subassembly 103. The cylindrical portion of the plenum-like space 179 may be of a diameter that makes intimate contact with an outside diameter of the gas rings 133 on the adjustment subassembly 103. The gas rings 133 may prevent gas from going forward through and fouling the matched-thread threaded portion 137 and a gas block threaded portion 185. To further prevent fouling of threaded portion 137 and gas block threaded portion 185, gas that escapes past the gas rings 133 may be channeled away through one or more ducts 187.

Figure 2:
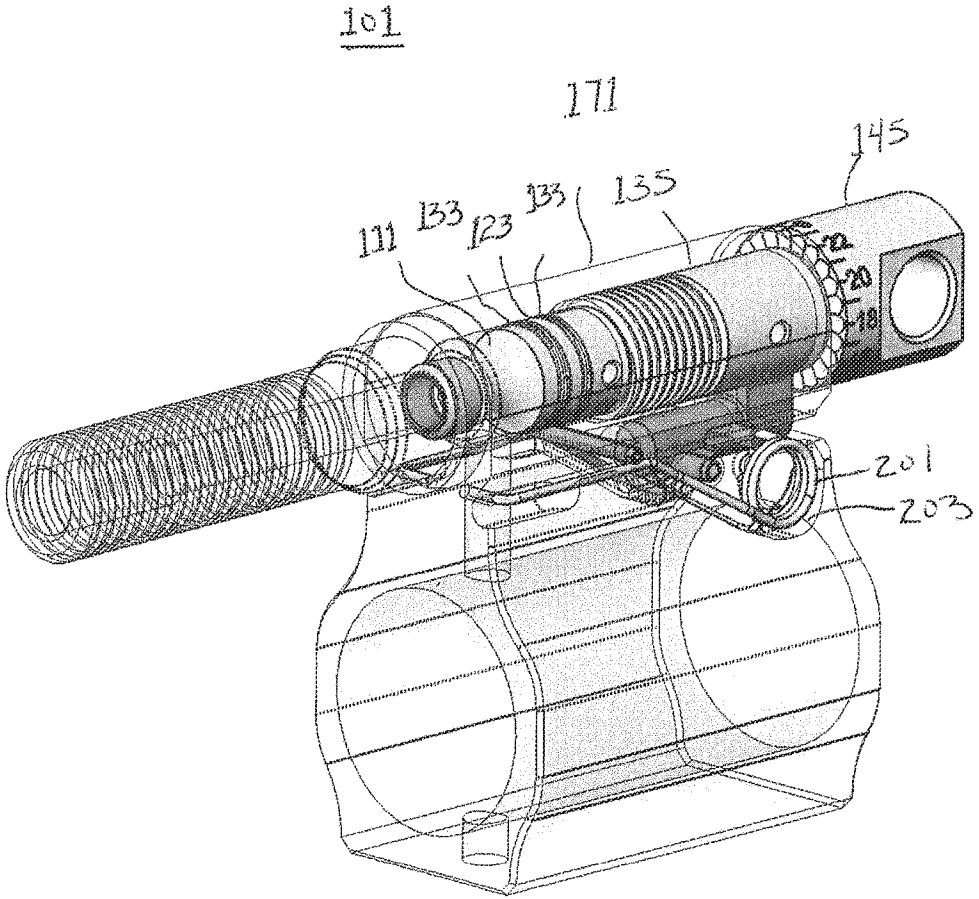
FIG. 2 shows an assembled adjustable gas block assembly, according to one embodiment.

FIG. 2 illustrates an assembled view of the adjustable gas block 101. As shown, the components are fit together. From the rear to the front, the components are shown as the valve stem end 111, gas rings 133, valve ring 123, gas rings 133, valve threaded portion 135, and valve rotator 145. The components interact with and couple to the gas block assembly 171 as described herein. An exterior mounted torsion spring 201 for a detent 203 may be provided.

Certain embodiments may utilize different configurations and sizes of various components. Each element and variation thereof described herein may be used interchangeably, if desired.

Figure 3:
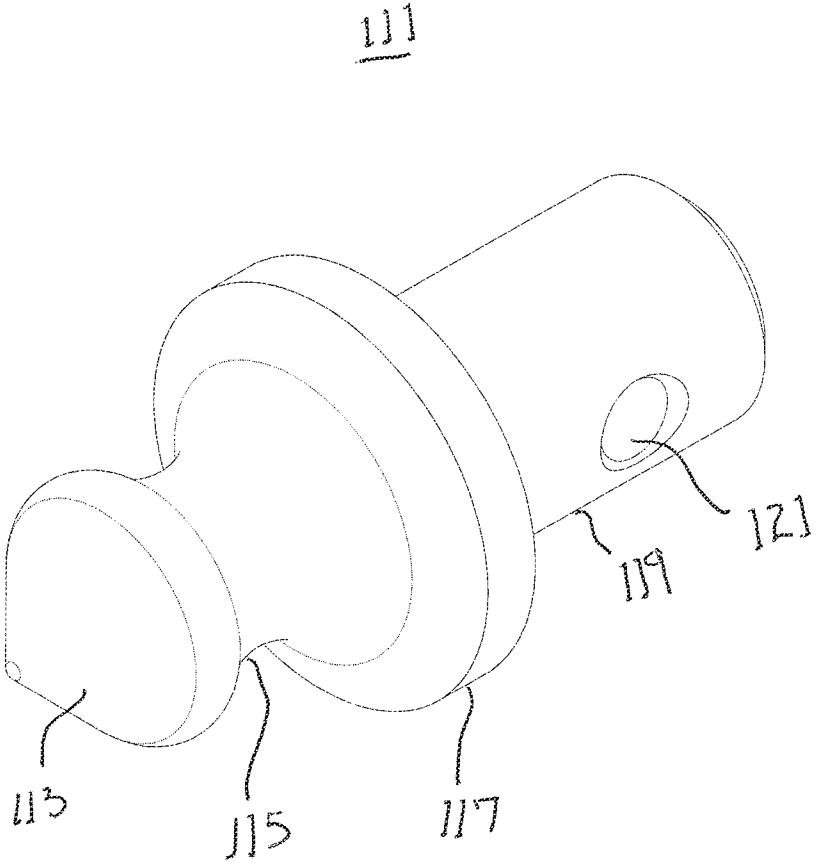
FIG. 3 shows an exemplary valve stem component, according to one embodiment.

FIG. 3 shows a detailed view of the valve stem end 111.

Figure 4:
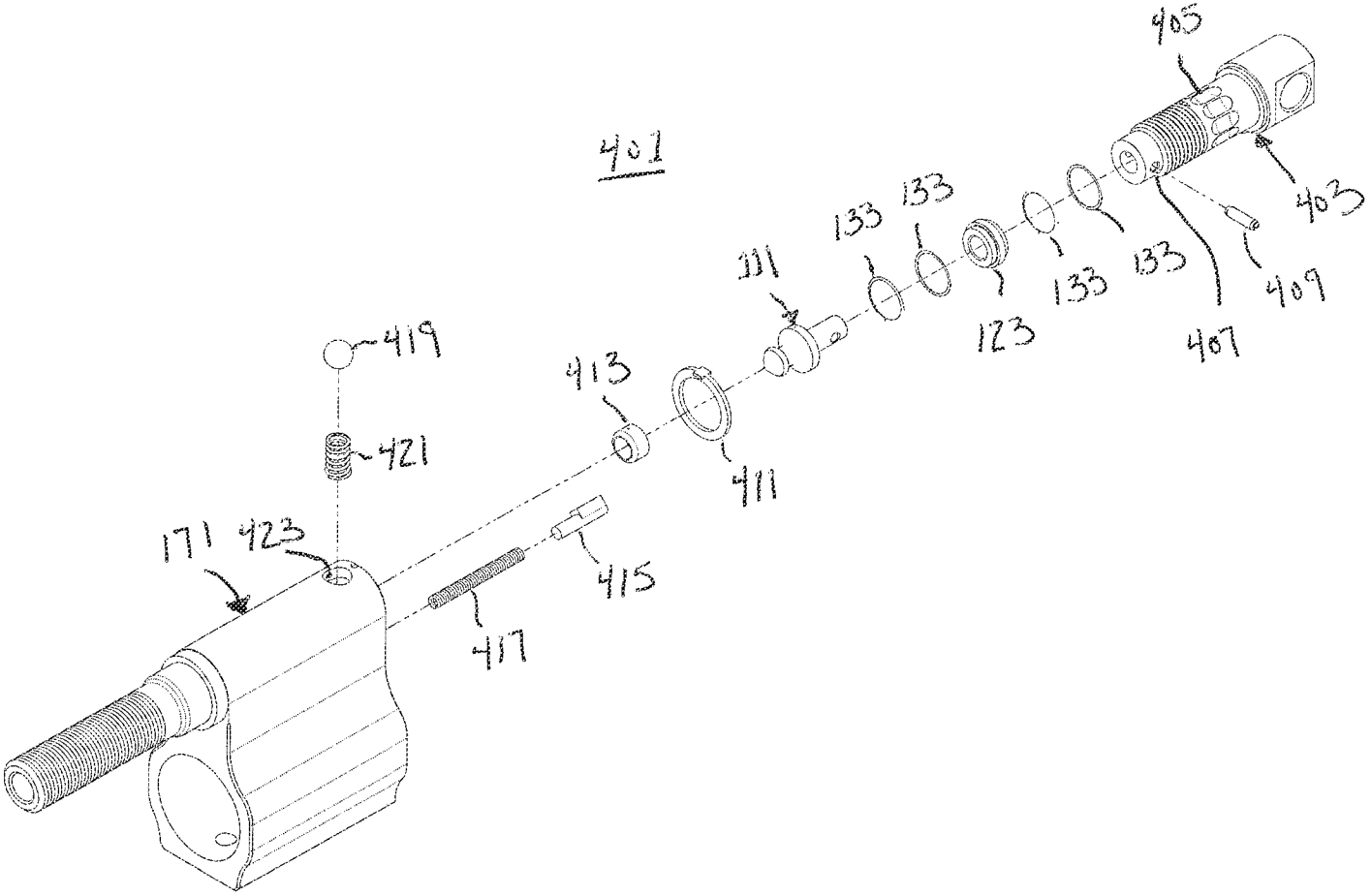
FIG. 4 shows an exploded view of an adjustable gas block assembly, according to one embodiment.

FIG. 4 shows an alternative adjustable gas block 401. The function and operation of components may be similar to the embodiment shown in FIG. 1. In this embodiment, the valve rotator and valve threaded portion may be combined into a valve adjustment portion 403. At least a portion of the valve adjustment portion 403 may include grooves 405. A through hole 407 may allow passage of a pin 409 to secure the valve stem end 111 to the valve adjustment portion 403. A rotation doubler 411 may be located between the valve stem end 111 and the gas block assembly 171. A valve seat 413 may be located between the rotation doubler 411 and the gas block assembly 171. A rotation limit pin 415 with an associated spring 417 may be provided as well to limit rotation. A ball 419 may be associated with a spring 421 and a hole 423.

Figure 5:
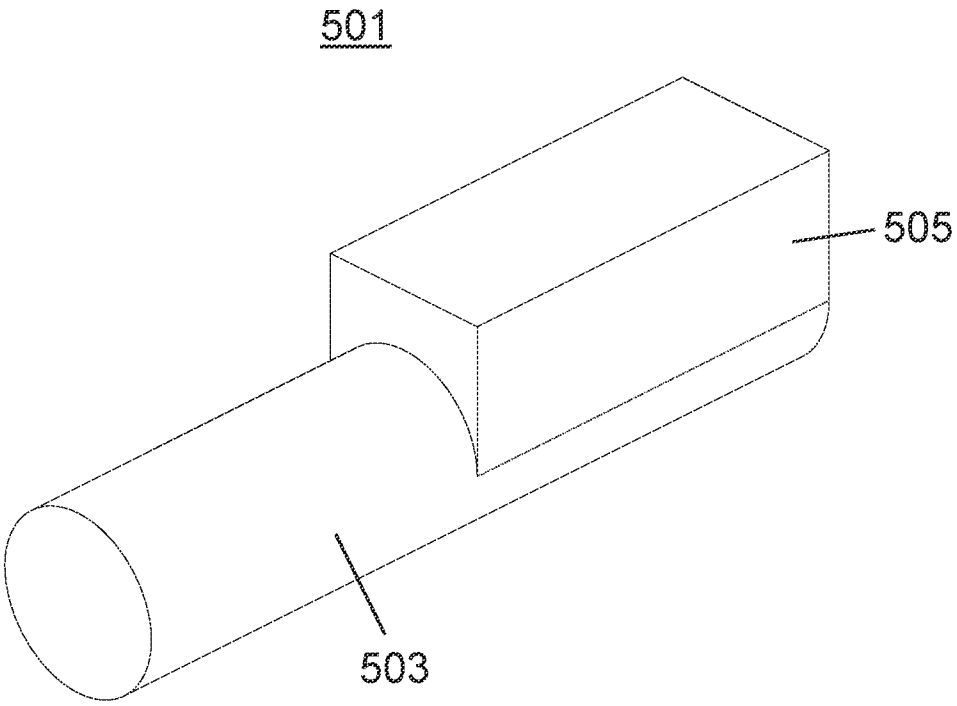
FIG. 5 shows an exemplary rotation limit pin, according to one embodiment.
Figure 6:
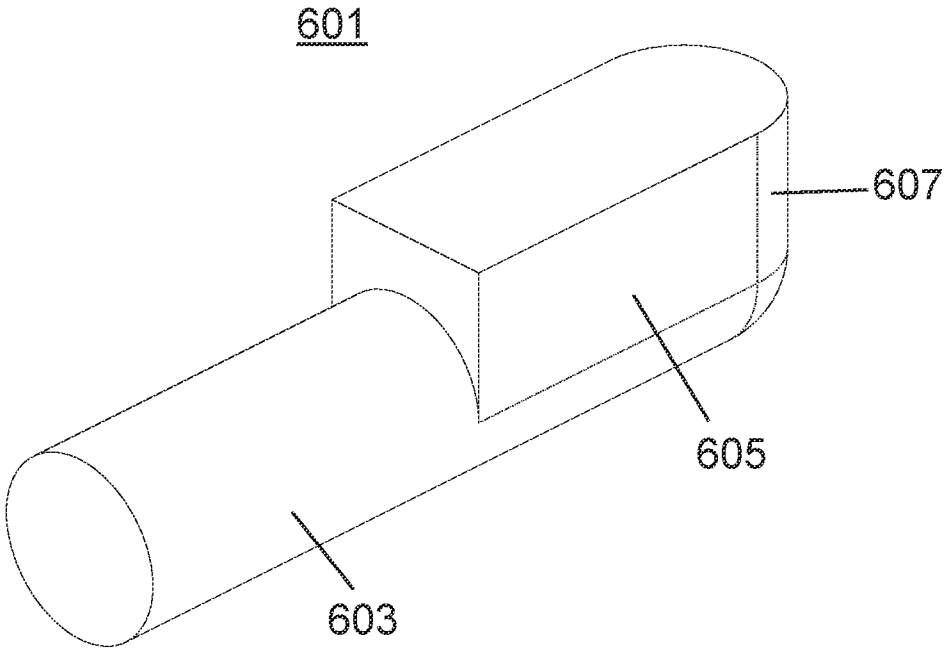
FIG. 6 shows an exemplary rotation limit pin, according to one embodiment.

The rotation limit pin may be modified depending on desired uses and operation. FIGS. 5-6 illustrate various exemplary embodiments of the rotation limit pin.

FIG. 5 shows a detail of a rotation limit pin 501. The rotation limit pin 501 may have a generally cylindrical portion 503. A block portion 505 may extend from one end, such as the forward end, of the cylindrical portion 503.

FIG. 6 shows a detail of an alternative rotation limit pin 601. The rotation limit pin 601 may have a generally cylindrical portion 603. A block portion 605 may extend from one end, such as the forward end, of the cylindrical portion 603. One end 605 of the rotation limit pin 601, such as the forward end may be rounded off. In certain embodiments, both the block portion 605 and the cylindrical portion 603 may be rounded off and may have complementary shapes.

Figure 7:
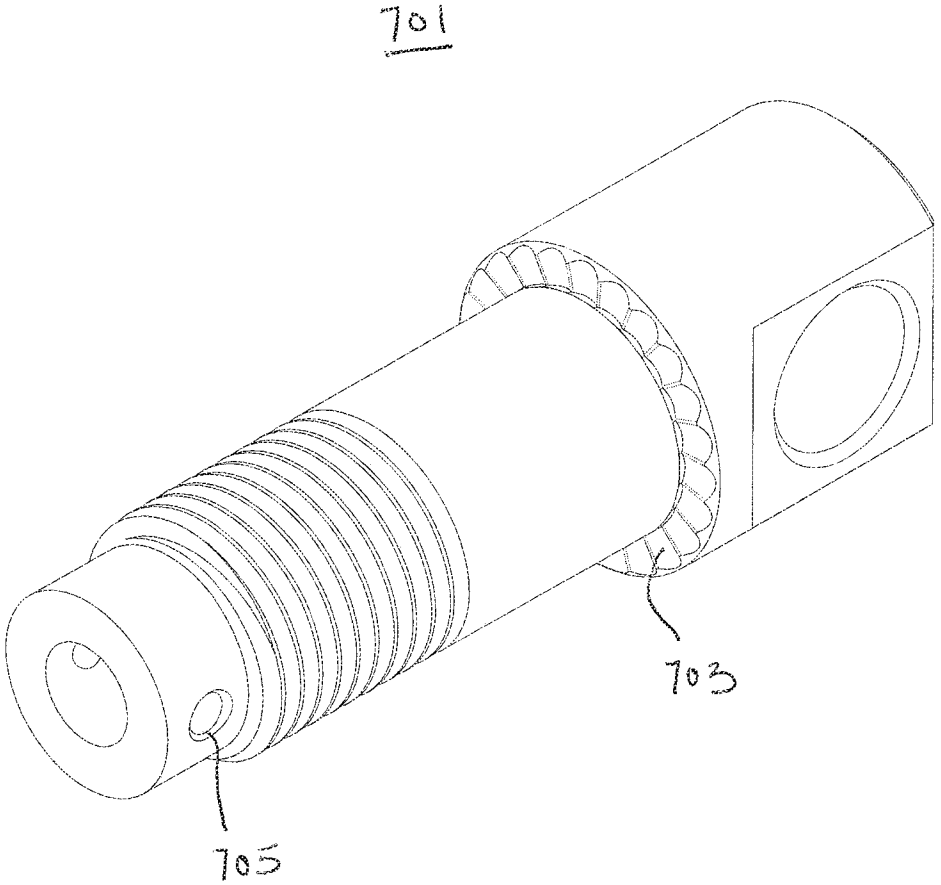
FIG. 7 shows an exemplary valve adjustment portion, according to one embodiment.
Figure 8:
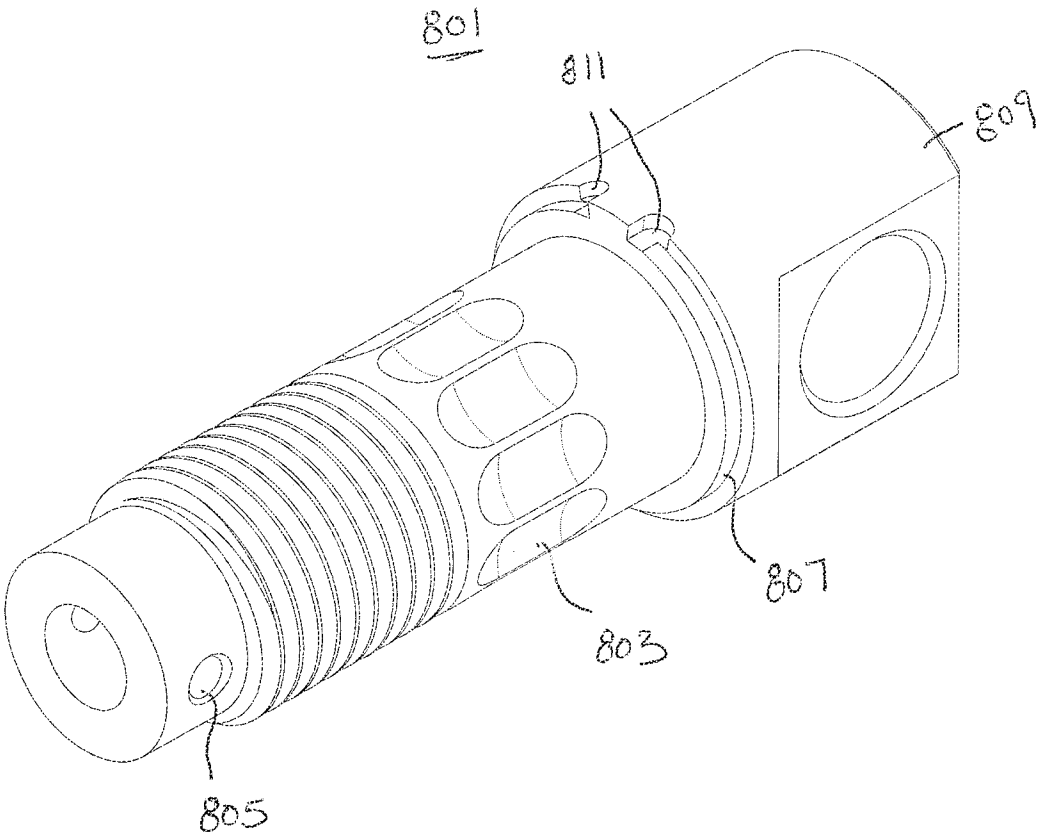
FIG. 8 shows an exemplary valve adjustment portion, according to one embodiment.

The valve stem may be modified depending on desired uses and operation. For example, the detents/grooves may be varied in location, number, size, etc. to create a desired operation. More detents/grooves may provide finer adjustment resolution. A locknut-like element may provide for continuously variable adjustment. In certain embodiments, a wider area on the adjustment knob may be provided. Numbers on the adjustment knob may provide numbers or characters to facilitate user adjustment to a set position. A finer thread pitch may increase resolution. Slots in the end face may accept screw driver blades or coins to facilitate adjustment. A replacement seat may be incorporated, if desired. FIGS. 7-8 illustrate various exemplary embodiments of the valve stem.

FIG. 7 shows a detailed view of a combined valve rotator and valve threaded portion creating a valve adjustment portion 701. At least a portion of the valve adjustment portion 701 may include grooves 703. A through hole 705 may allow passage of a pin (not shown) to secure the valve stem end 111 to the valve adjustment portion 701.

FIG. 8 shows a detailed view of a combined valve rotator and valve threaded portion creating a valve adjustment portion 801. At least a portion of the valve adjustment portion 801 may include grooves 803. A through hole 805 may allow passage of a pin (not shown) to secure the valve stem end 111 to the valve adjustment portion 801. A circumferential groove 807 may surround a portion of the valve adjustment portion, such as a forward end 809. The circumferential groove 807 may have one or more stop positions 811 located around the circumference of the valve adjustment portion 801.

Certain embodiments may include a firearm utilizing an adjustable gas block. The firearm may include a receiver, a barrel connected to the receiver, wherein the barrel has a gas port, and a gas operating system.

Certain embodiments may allow a user to adjust spent cartridge ejection angles.

Certain embodiments may provide for various positions of adjustment, each of which affects the flow of gas from the barrel gas port into the operating system of the host firearm. The herein disclosed device may be used with an indirect gas operating system, but it should be noted that this device is not limited to such operating systems and in fact could be utilized with a gas impingement operating system such as is found on the M16 family of firearms.

Various components of the adjustable gas block may be made from various materials and include various coatings/finishes. In certain embodiments, the finish may be NICORR (available from LWRC International). This may be a black, durable finish that takes its final appearance from the surfaces of the substrate to which it is applied.

Although the foregoing descriptions are directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. An adjustable gas block system comprising:

an adjustment subassembly comprising:

a valve stem end with a front-most portion larger in diameter than a rear-most portion and a boss extending from a forward portion of the valve stem end;

a valve ring surrounding the boss of the valve stem end;

a valve threaded portion for receiving the boss of the valve stem end and having a threaded portion; and a valve rotator coupled to the valve threaded portion for adjusting the flow of gas;

a gas block assembly comprising:

a gas block through hole;

a first duct to direct pressurized gas from a barrel to a plenum;

a second duct to direct a regulated volume of gas to a gas operating system;

a seat valve to control the regulated volume of gas to the gas operating system;

a gas block threaded portion for coupling to the valve threaded portion; and a rotation limit pin; and wherein the adjustment subassembly is coupled to the gas block assembly.

2. The system of claim 1, wherein the valve stem end further comprises a middle portion lesser in diameter than the rear-most portion.

3. The system of claim 1, further comprising a first through hole in the boss and a second through hole in the valve threaded portion for receiving a first sub-assembly pin to couple the valve stem end to the valve threaded portion.

4. The system of claim 1, further comprising one or more gas rings.

5. The system of claim 4, wherein one or more gas rings are located between the valve stem end and the valve ring and one or more gas rings are located between the valve ring and the valve rotator.

6. The system of claim 5, wherein the valve ring has a forward shoulder and a rear shoulder to each communicate with the one or more gas rings.

7. The system of claim 1, wherein the threaded portion of the valve threaded portion is on a reduced diameter shoulder of the valve threaded portion.

8. The system of claim 7, wherein a through hole in the valve threaded portion is on an unthreaded portion of the reduced diameter shoulder.

9. The system of claim 1, wherein the valve rotator and valve threaded portion are a unitary component.

10. The system of claim 1, wherein the valve rotator comprises a valve rotator boss at the rear of the valve rotator.

11. The system of claim 10, wherein the valve rotator boss fits within an axial opening of the valve threaded portion to couple the valve rotator to the valve threaded portion.

12. The system of claim 1, wherein the valve rotator comprises a ring of grooves.

13. The system of claim 12, wherein the grooves are evenly spaced around a circumference of the valve rotator.

14. The system of claim 1, wherein the valve rotator comprises one or more flat areas on a forward section of the valve rotator.

15. The system of claim 1, further comprising a through hole extending between two flat areas on a forward section of the valve rotator.

16. The system of claim 1, wherein the gas block assembly comprises a through hole for securing the gas block to a gas block journal on a rifle barrel.

17. The system of claim 1, wherein an inner diameter of the plenum contacts an outer diameter of one or more gas rings.

18. The system of claim 1, further comprising an exterior mounted torsion spring.

19. The system of claim 18, wherein the exterior mounted torsion spring is in a detent.

20. The system of claim 1, further comprising more than four grooves on the valve rotator to set adjustment of the adjustable gas block assembly.

* * * * *